US010458180B2

(12) United States Patent
Wright et al.

(10) Patent No.: US 10,458,180 B2
(45) Date of Patent: Oct. 29, 2019

(54) FENCE GATE ASSEMBLY, FENCE GATE KIT, SYSTEM AND METHODS OF MANUFACTURING THEREOF

(71) Applicant: BARRETTE OUTDOOR LIVING, INC., Middleburg Heights, OH (US)

(72) Inventors: Douglas Grant Wright, Morristown, TN (US); Christopher Rolland Clark, Jefferson City, TN (US); Christopher Michael Schneider, Mays Landing, NJ (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 628 days.

(21) Appl. No.: 15/263,799

(22) Filed: Sep. 13, 2016

(65) Prior Publication Data

US 2018/0073297 A1 Mar. 15, 2018

(51) Int. Cl.
*E06B 11/02* (2006.01)
*E06B 3/70* (2006.01)

(52) U.S. Cl.
CPC ..... *E06B 11/02* (2013.01); *E06B 3/7003* (2013.01)

(58) Field of Classification Search
CPC .... E04H 2017/1447; E04H 2017/1465; E04H 2017/1491; E04H 17/1421; E06B 11/02; E06B 11/026; E06B 11/028; E06B 11/022
USPC ..... 256/73
See application file for complete search history.

(56) References Cited

U.S. PATENT DOCUMENTS 4,072,294 A * 2/1978 Densen ..... E04F 11/181 256/24
4,278,361 A 7/1981 Steinke
6,491,286 B1 * 12/2002 Hadfield, Sr. ..... E06B 11/02 256/21
6,668,500 B1 12/2003 Lamberts
6,761,008 B2 7/2004 Chen et al.
6,881,005 B2 * 4/2005 Sosa ..... E06B 3/964 256/65.05
7,232,114 B2 * 6/2007 Platt ..... E04H 17/1413 256/65.04
7,427,055 B2 9/2008 Platt
7,698,871 B2 * 4/2010 Mansueto ..... E06B 3/9642 52/656.7
8,132,791 B2 * 3/2012 Stucker ..... E04H 17/1421 256/19
8,167,275 B1 * 5/2012 Bizzarri ..... E04F 11/181 256/65.08

(Continued)

FOREIGN PATENT DOCUMENTS

GB 2191556 A 12/1987
JP 2001032657 A 2/2001

(Continued)

*Primary Examiner* — Jonathan P Masinick
(74) *Attorney, Agent, or Firm* — John Maldjian; Maldjian Law Group LLC

(57) ABSTRACT

A fence gate assembly comprises an upright having a longitudinal opening and a lateral opening. The assembly also includes an insert received within the longitudinal opening and coupled to the upright. The insert also includes a support portion extending from a rear wall. The assembly further includes a rail at least partially received within a cavity of the insert, the rail including a channel configured to at least partly receive the support portion therein.

20 Claims, 11 Drawing Sheets

(56) References Cited

U.S. PATENT DOCUMENTS

| | | | | |
|---|---|---|---|---|
| 8,511,648 | B2 * | 8/2013 | McCarthy | E04H 17/1404 256/67 |
| 8,646,756 | B2 * | 2/2014 | Mann | E06B 3/76 256/73 |
| 8,919,742 | B2 * | 12/2014 | Williams, Sr. | E04H 17/16 256/65.11 |
| 9,228,372 | B2 | 1/2016 | Bertato | |
| 9,458,667 | B2 * | 10/2016 | Bugh | E06B 11/02 |
| 9,470,041 | B2 * | 10/2016 | Ash | E04H 17/1413 |
| 9,663,965 | B2 * | 5/2017 | Ramon | E01F 13/022 |
| 10,294,674 | B2 * | 5/2019 | Guo | E04F 11/1812 |
| 2004/0026679 | A1 * | 2/2004 | Terrels | E04H 17/1443 256/65.03 |
| 2006/0091372 | A1 | 5/2006 | Rosian | |
| 2007/0012903 | A1 | 1/2007 | Stucky | |
| 2010/0193756 | A1 * | 8/2010 | Buckley | E04H 17/1413 256/65.04 |
| 2011/0107713 | A1 | 5/2011 | Mullet et al. | |
| 2014/0033634 | A1 | 2/2014 | Pervan | |
| 2014/0109501 | A1 | 4/2014 | Darko | |
| 2014/0252293 | A1 * | 9/2014 | Miller | E06B 11/02 256/73 |
| 2014/0255081 | A1 | 9/2014 | Liebscher et al. | |
| 2015/0021534 | A1 * | 1/2015 | Molina | E04H 17/1439 256/65.12 |
| 2015/0033659 | A1 | 2/2015 | Brandt et al. | |
| 2015/0300027 | A1 | 10/2015 | Day et al. | |
| 2018/0266119 | A1 * | 9/2018 | Schneider | E04F 11/1817 |

FOREIGN PATENT DOCUMENTS

| | | | |
|---|---|---|---|
| JP | 2003307080 | A | 10/2003 |
| WO | 9717505 | A1 | 5/1997 |
| WO | 02057556 | A1 | 7/2002 |

* cited by examiner

1

502

FENCE GATE ASSEMBLY, FENCE GATE KIT, SYSTEM AND METHODS OF MANUFACTURING THEREOF

BACKGROUND

Fences and fence gates typically are installed in outdoor areas, such as lawns, yards, gardens outdoor decks, and so forth. A fence or a fence gate includes one or more posts fixed to the ground, an upright coupled to each post, and rails coupled to the upright.

Conventionally, the rails are coupled to the upright by external coupling mechanisms, for example, external fasteners or brackets. However, external coupling mechanisms are visible after assembly of the fence gate or fence, and therefore may be aesthetically unappealing.

Further, manufacturers typically provide fence gate kits that include various components that have to be assembled on-site by a customer. Assembling individual components with each other, including coupling the uprights with the rails, may be a time consuming and complex task, especially for an unskilled customer. For example, the customer may have to install multiple fasteners, brackets, and so forth, in order to couple the uprights with the rails. The assembly process also may require usage of various tools that may be unavailable to the customer or difficult to operate. Customers inexperienced with installing fences, misuse of tools, intentional unauthorized shortcuts, and other human errors when installing fences may leave persons susceptible to accidents.

Thus, there is a need for a fence gate system and method of assembly that minimizes use of tools, enhances safety, and does not require specialized skills. Such a system and method may facilitate efficient on-site assembly of fence gates or fences. There is also a need for a fence gate system that is aesthetically pleasing by reducing a use of visible external coupling mechanisms.

SUMMARY

Embodiments of the invention generally are directed to a fence gate assembly and methods of assembling the fence gate assembly. More particularly, embodiments of the invention are directed to a fence gate kit, an insert of the fence gate kit, a fence gate system, methods of assembling the fence gate kit and methods of manufacturing the fence gate kit.

Embodiments disclosed herein relate to an insert for coupling an upright with a rail of a gate, a fence and the like. More specifically, the embodiments disclosed herein relates to an insert coupled within the upright and couples the upright with the rail of a fence gate. The insert is pre-installed within the upright so that an on-site assembly process of the fence gate may be simplified and be safer. Moreover, since the insert is installed within the upright, the fence gate, in an assembled state, may be more aesthetically pleasing.

Embodiments in accordance with the present invention are directed to a fence gate assembly. The assembly may include an upright including a first wall, a second wall opposite to the first wall, a third wall extending between the first and the second wall, and a fourth wall spaced from the third wall and extending between the first wall and the second wall, wherein the first wall, the second wall, the third wall and the fourth wall create a longitudinal opening The assembly also may include an insert received within the longitudinal opening of the upright and coupled to the upright via an adhesive. Further, the insert may include a rear wall abutting the second wall of the upright in the coupled state of the insert and a pair of side walls extending from the rear wall, wherein the rear wall and the pair of side walls at least partly forms a cavity. The insert may further include a support portion extending from the rear wall and disposed between the pair of side walls. The assembly also may include a rail coupled to the insert and extending at least partially within the cavity of the insert.

Embodiments in accordance with the present invention further provide a method of manufacturing a fence gate kit that may be assembled into a fence gate. The method may include providing an upright including a first wall, a second wall opposite to the first wall to form a lateral opening, a third wall extending between the first and second wall, and a fourth wall spaced from the third wall and extending between the first wall and the second wall, wherein the first wall, the second wall, the third wall and the fourth wall form a longitudinal opening. The method also may include sliding an insert within the longitudinal opening of the upright, the insert including a rear wall, a pair of side walls extending from the rear wall, and a support portion extending from the rear wall and disposed between the pair of side walls, wherein the rear wall and the side walls at least partly form a cavity. The method may further include coupling the insert to the upright via an adhesive; and inserting a rail through the lateral opening and at least partly received within the cavity of the insert, the rail comprising a channel slidably received on the support portion of the insert.

Embodiments in accordance with the present invention further provide a fence gate system. The system may include a post extending from a ground surface; a hinge coupled to the post; and an upright coupled to the hinge, wherein the upright includes a first wall having a lateral opening, a second wall opposite to the first wall, a third wall extending between the first and second wall, and a fourth wall spaced from the third wall and extending between the first wall and the second wall, wherein the first wall, the second wall, the third wall and the fourth wall forming a longitudinal opening. The system also may include an insert received within the longitudinal opening of the upright and coupled to the upright via an adhesive, the insert including a rear wall abutting the second wall of the upright in the coupled state of the insert; a pair of side walls extending from the rear wall, wherein the pair of side walls and the rear wall at least partly forms a cavity; and a support portion extending from the rear wall and disposed between the pair of side walls. The system also may include a rail inserted through the lateral opening and at least partially received within the cavity of the insert, the rail further comprising a channel to receive at least partially the support portion therein, wherein the rail is coupled to the insert. The system may further include multiple balusters slidably received with the channel of the rail and a cap configured to close the longitudinal opening of the upright.

Embodiments of the present invention may provide a fence gate assembly and system, a fence gate kit, a method of manufacturing the fence gate kit and methods for assembling the fence gate that simplify an on-site assembly of the fence gate, enhance safety during assembly and improve aesthetic appeal of the fence gate in the assembled state.

These and other advantages will be apparent from the present application of the embodiments described herein.

The preceding is a simplified summary to provide an understanding of some embodiments of the present invention. This summary is neither an extensive nor exhaustive overview of the present invention and its various embodiments. The summary presents selected concepts of the embodiments of the present invention in a simplified form as an introduction to the more detailed description presented below. As will be appreciated, other embodiments of the present invention are possible utilizing, alone or in combination, one or more of the features set forth above or described in detail below.

BRIEF DESCRIPTION OF THE DRAWINGS

The foregoing and other aspects of the embodiments disclosed herein are best understood from the following detailed description when read in connection with the accompanying drawings. For the purpose of illustrating the embodiments disclosed herein, there is shown in the drawings embodiments that presently are preferred, it being understood, however, that the embodiments disclosed herein are not limited to the specific instrumentalities disclosed. Included in the drawings are the following figures.

Figure 1:
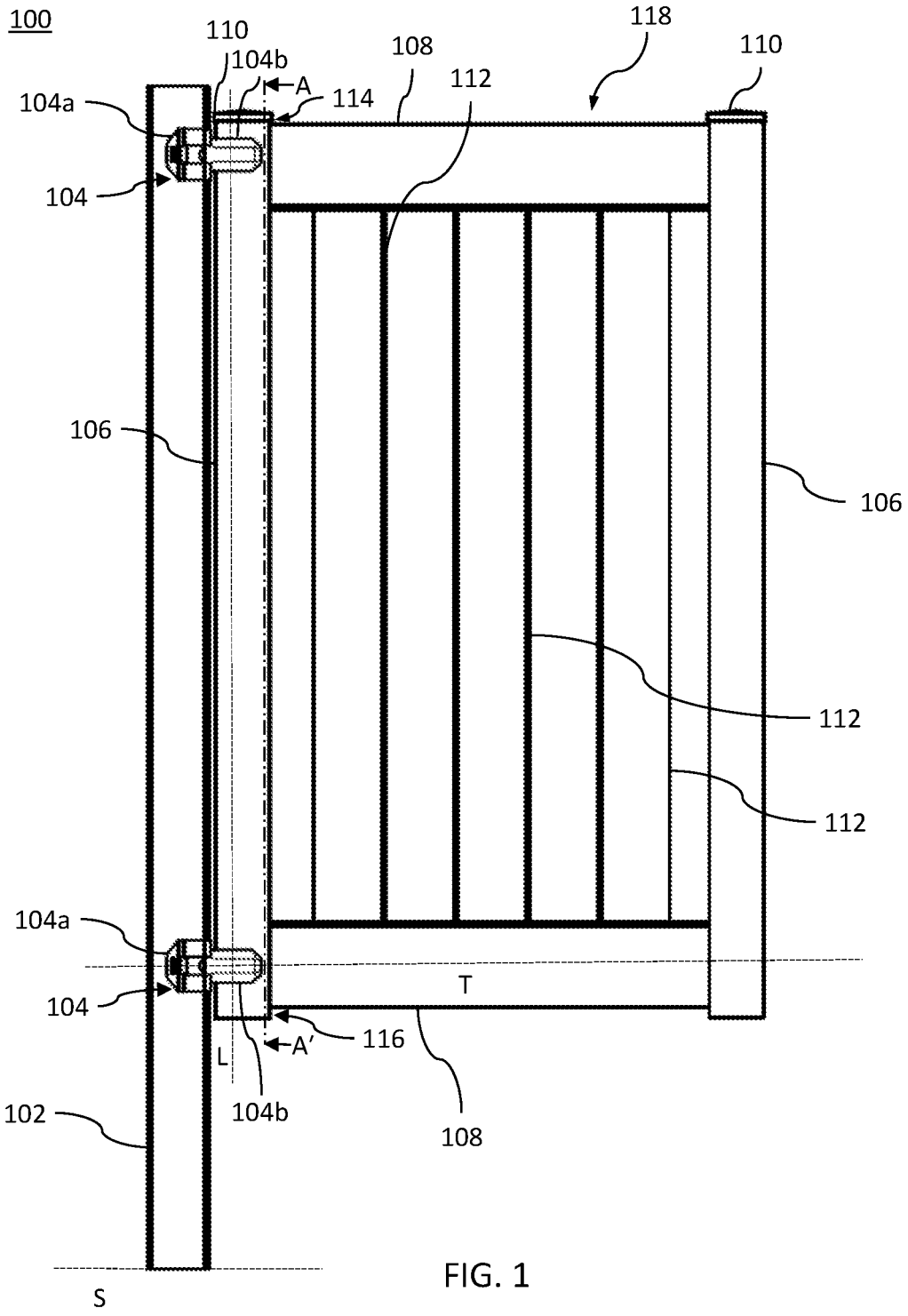
FIG. 1 is a side view of a fence gate system, according to embodiments disclosed herein.

While embodiments of the present invention are described herein by way of example using several illustrative drawings, embodiments of the invention are not limited to the embodiments or drawings described. The drawings and the detailed description thereto are not intended to limit the present invention to the particular form disclosed, but also encompass all modification, equivalents and alternatives falling within the spirit and scope of embodiments of the present invention as recited by the claims.

The headings used herein are for organizational purposes only and are not meant to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

DETAILED DESCRIPTION

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" may be used interchangeably herein. The terms "comprising", "including", and "having" also may be used interchangeably.

FIG. 1 illustrates a side view of a fence gate system 100, according to an embodiment of the present disclosure. Fence gate system 100 may be installed in any outdoor region, including, but not limited to, yards, lawns, gardens, outdoor decks, porches, and the like.

Fence gate system 100 includes a post 102, a pair of hinges 104, a pair of uprights 106, a pair of rails 108, a pair of caps 110 and a plurality of balusters 112. As illustrated in FIG. 1, post 102 extends from a ground surface 'S'. Post 102 may be embedded partially within the ground such that post 102 is substantially stationary with respect to ground surface 'S'. Post 102 may be a hollow or solid elongated structure having any suitable cross-section, for example, but not limited to, rectangular, square, polygonal, oval, circular, elliptical, and so forth. Post 102 also may have ribs (not shown) to impart rigidity to the hollow elongated structure.

The pair of hinges 104 pivotally connect post 102 to adjacent upright 106. One of pair of hinges 104 is positioned proximate to a top end of post 102, while the other hinge 104 is positioned distal to the top end of post 102. A first part 104*a* of each of hinges 104 is connected to post 102, while a second part 104*b* of each of hinges 104 is connected to upright 106. Further, first part 104*a* and second part 104*b* are connected pivotally to each other. Therefore, hinges 104 may allow pivotal movement of upright 106 with respect to post 102. Hinges 104 may be connected to post 102 and upright 106 via various methods, such as mechanical fasteners, adhesives, or a combination thereof.

Each of uprights 106 may have a hollow elongated structure having a longitudinal axis 'L'. Further, each of uprights 106 has a top end 114 and a bottom end 116. A top longitudinal opening (not shown in FIG. 1) of each of uprights 106 is closed by cap 110. Further, the pair of rails 108 are disposed between the pair of uprights 106. Rails 108 extend along a transverse axis 'T', which is substantially perpendicular to longitudinal axis 'L'. One of pair of rails 108 is located proximate to top end 114 of each of uprights 106, while the other rail 108 is located proximate to bottom end 116 of each of uprights 106. Rails 108 may be coupled to uprights 106 via inserts (not shown in FIG. 1).

Balusters 112 are connected to and disposed between rails 108. In various embodiments, one or more U-channels (not shown) also may be located adjacent to uprights 106 in order to retain balusters 112 between uprights 106. Although columnar balusters are illustrated, a variety of shapes are usable for balusters 112. Each of balusters 112 may have substantially flat hollow structures. Balusters 112 may abut each other or a clearance may exist between them.

Hinges 104, uprights 106, rails 108, caps 110 and balusters 112 may form a fence gate assembly 118 that is pivotally coupled to post 102. The components of fence gate assembly 118 may be part of a fence gate kit that is assembled on-site and coupled to post 102. Alternatively, post 102 also may be part of the fence gate kit.

Fence gate system 100 and fence gate assembly 118, as described above, are purely exemplary in nature, and various alternatives may be envisioned within the scope of the disclosure. For example, fence gate system 100 may have three rails 108, three hinges 104, and a plurality of balusters 112.

Figure 2A:
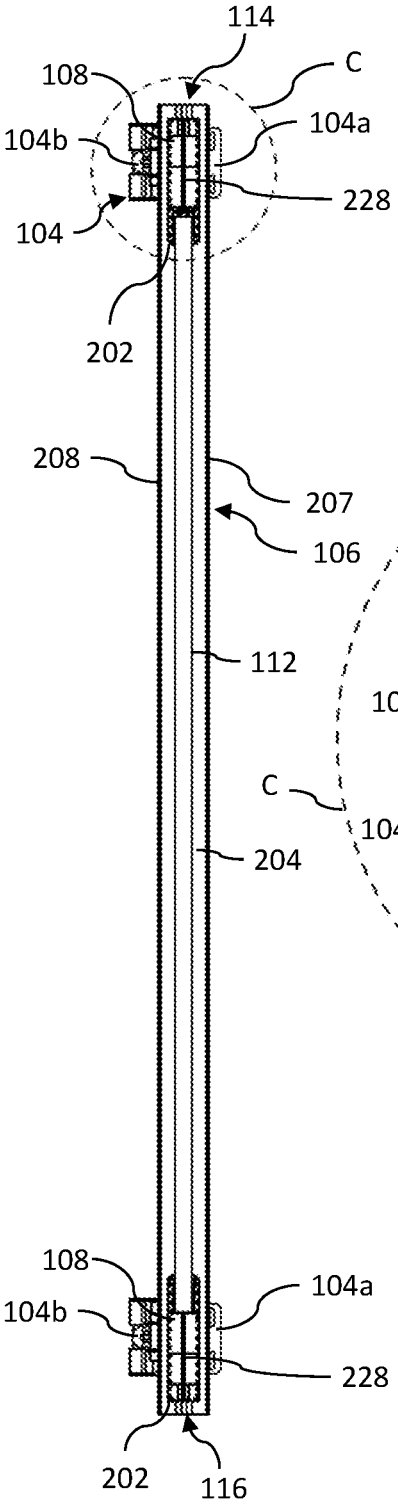
FIG. 2A is a sectional view of a portion of the fence gate system taken at line A-A' of FIG. 1 with a cap removed.

FIG. 2A is a sectional view of upright 106 of fence gate system 100 with cap 110 (shown in FIG. 1) removed. Upright 106 of FIG. 2A is located adjacent to post 102 (shown in FIG. 1). However, various internal components, as shown in FIG. 2A, may be common to both uprights 106. As illustrated in FIG. 2A, two inserts 202 are coupled to upright 106 in order to secure corresponding rails 108 to upright 106. One of inserts 202 are located proximate to top end 114 of upright 106, while the other insert 202 is located proximate to bottom end 116 of upright 106. In an exemplary embodiment, fence gate assembly 118 may be provided with two inserts 202 positioned at top end 114 and bottom end 116 of upright 106. However, a number and positions of inserts 202 may vary as required by the size of the installed fencing.

Figure 2B:
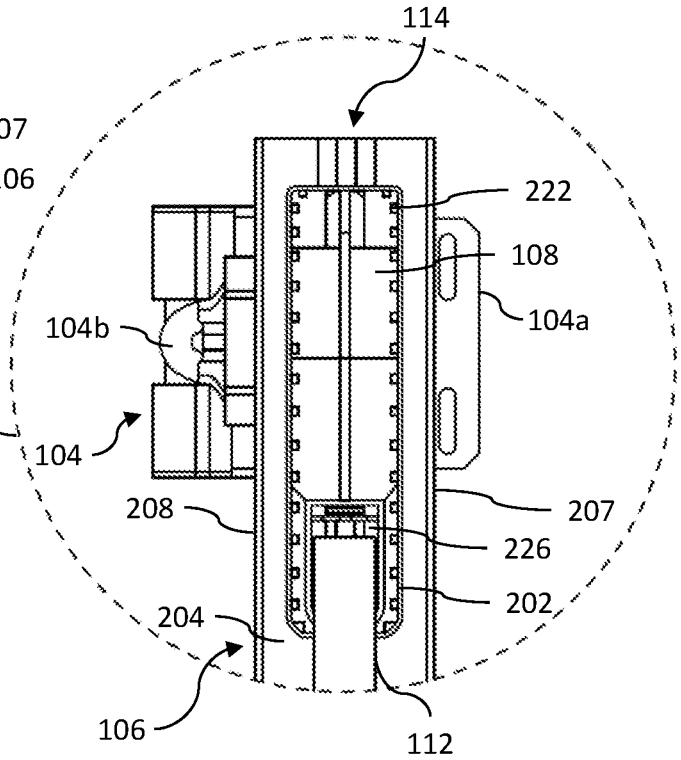
FIG. 2B is a detailed sectional view of the portion of the fence gate system of FIG. 2A.
Figure 3:
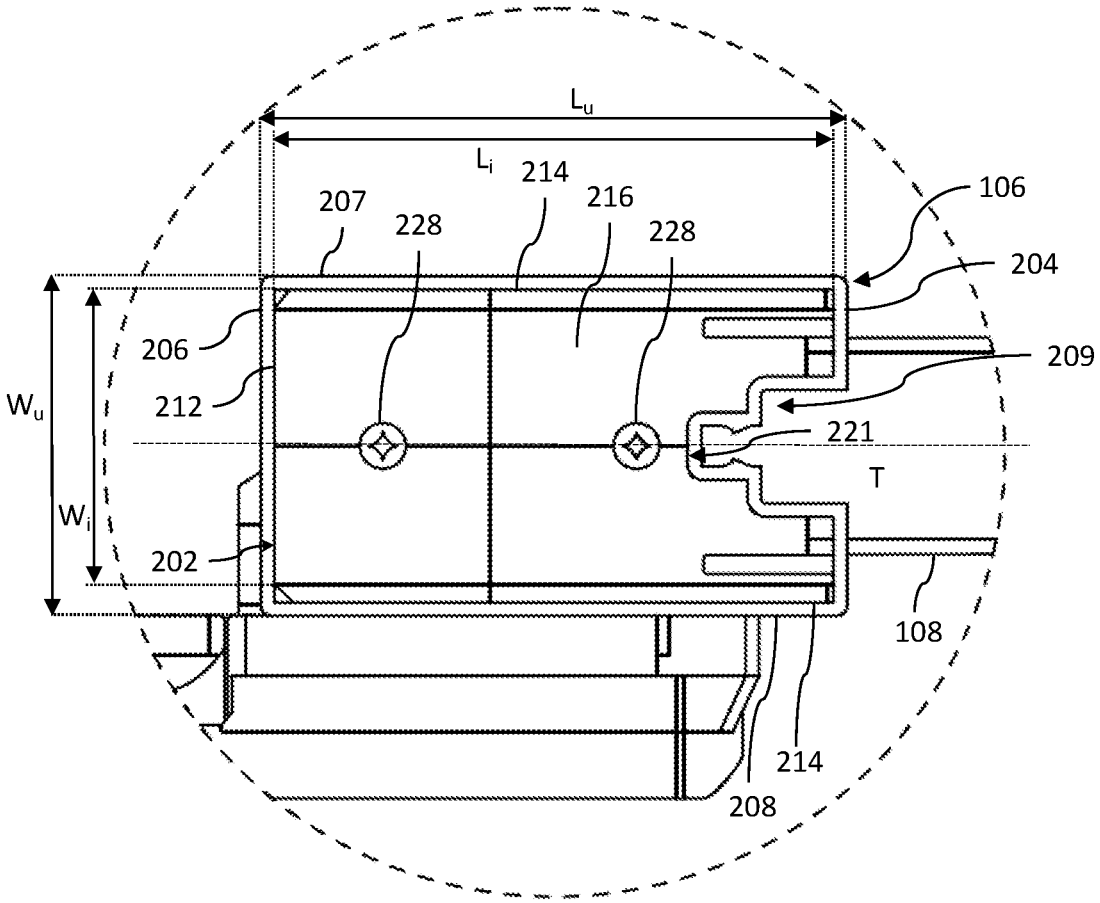
FIG. 3 is a top view of an upright of the fence gate system of FIG. 1 with the cap removed, according to embodiments disclosed herein.
Figure 4:
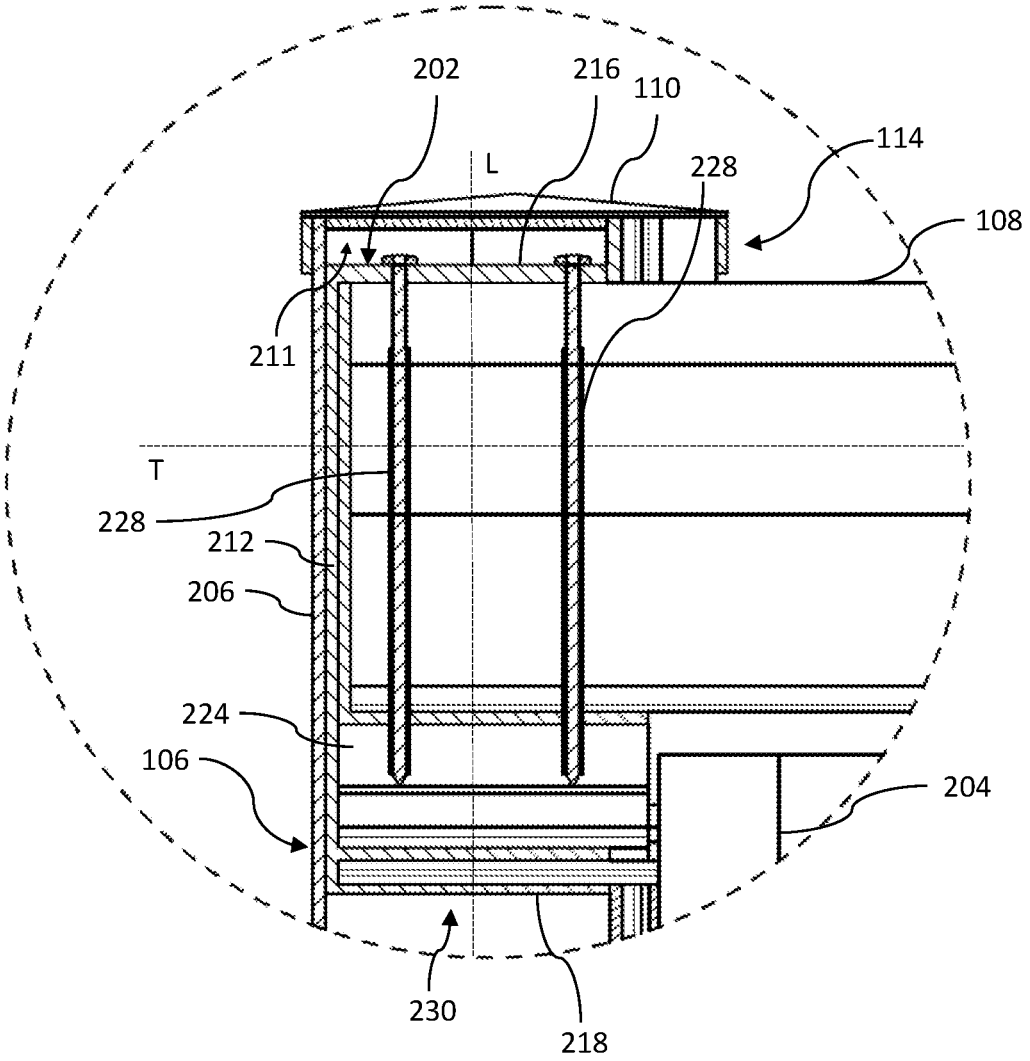
FIG. 4 is a detailed sectional view of a portion of the fence gate system of FIG. 1.
Figure 5A:
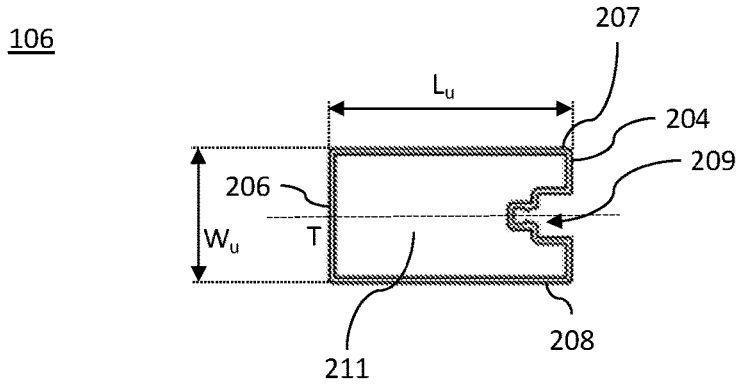
FIG. 5A illustrates a top view of an upright of the fence gate system, according to embodiments disclosed herein.
Figure 5B:
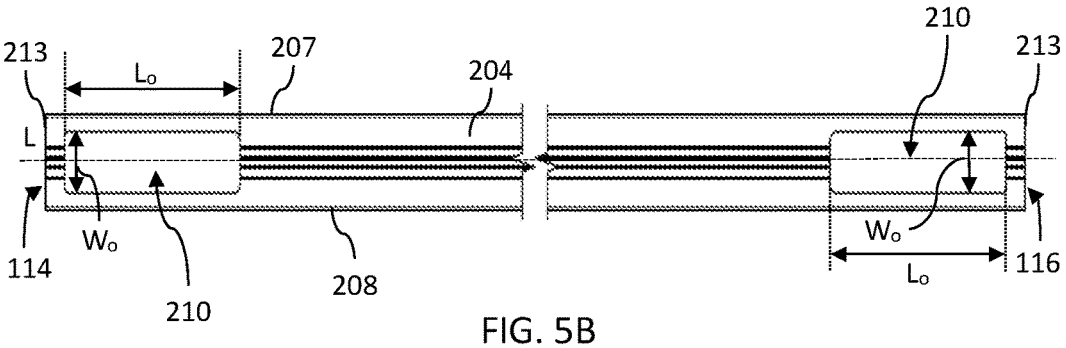
FIG. 5B illustrates a front view of the upright of FIG. 5A.

FIG. 2B is a detailed view of a region 'C' of FIG. 2A. FIG. 3 is a top view of upright 106 with cap 110 removed. FIG. 4 is a detailed sectional view of fence gate system 100. FIGS. 5A and 5B are top and front views of upright 106, respectively. Referring to FIGS. 2B, 3, 4, 5A and 5B, upright 106 includes a first wall 204, a second wall 206 opposite to first wall 204, a third wall 207 extending between first wall 204 and second wall 206, and a fourth wall 208 spaced from third wall 207 and extending between first wall 204 and second wall 206. In the illustrated embodiment, third and fourth walls 207, 208 are substantially parallel to each other. First second, third and fourth walls 204, 206, 207 and 208 may have substantially any shape to provide a suitable cross-section to upright 106. For example, first, second, third and fourth walls 204, 206, 207 and 208 may be curvilinear, rectangular, and so forth. Upright 106 also may have any cross-section, for example, but not limited to, rectangular, square, polygonal, oval, circular, elliptical, and so forth. In the illustrated embodiment, upright 106 has a width 'Wu' and a length 'Lu'. Further, upright 106 may have stiffening ribs (not shown) that impart structural strength.

First wall 204 may include a groove 209 that receives one of the U-channels or a portion of balusters 112 in order to form a mechanical joint. First wall 204 further includes a pair of lateral openings 210. One of lateral openings 210 is proximate to top end 114 of upright 106 and receives one of rails 108, while the other lateral opening 210 is proximate to bottom end 116 of upright 106 and receives the other rail 108.

In an embodiment, lateral openings 210 may be substantially parallel to transverse axis 'T'. Each of lateral openings 210 may be rectangular, oval, elliptical, circular, and so forth. Further, lateral openings 210 may have chamfered or filleted edges. In the illustrated embodiment, each of lateral openings 210 are substantially rectangular with a width 'Wo' and a length 'Lo'.

The first, second, third and fourth walls 204, 206, 207, 208 includes a longitudinal opening 211 at each of top and bottom ends 114, 116 of the upright. In an embodiment, longitudinal opening 211 may extend along longitudinal axis 'L'. Further, longitudinal opening 211 may extend from top end 114 to bottom end 116 of upright 106. Each of longitudinal opening 211 receives insert 202. Further, first wall 204, second wall 206, third wall 207 and fourth wall 208 may include an end surface 213 at each of top end 114 and bottom end 116 of upright 106.

Insert 202 includes a rear wall 212, a pair of side walls 214 extending from rear wall 212, a top wall 216 extending from rear wall 212 and a bottom wall 218 opposite to top wall 216. Therefore, a front end of insert 202 is open to enable insertion of rail 108. Rear wall 212, side walls 214, top wall 216 and bottom wall 218 together form a cavity 220 (shown in FIG. 7C) to at least partly receive corresponding rail 108 therein. Each of top wall 216 and bottom wall 218 may include a groove 221 similar in shape to groove 209 of upright 106. Further, top and bottom walls 216, 218 may have a width 'Wi' and a length 'Li' such that insert 202, in the coupled state, may be located entirely within upright 106. Bottom wall 218 also may support rail 108 thereon. Therefore, width 'Wi' and length 'Li' may be lesser than or equal to width 'Wu' and length 'Lu', respectively, of upright 106. Further, such dimensions of insert 202 also enable insertion of insert 202 through longitudinal opening 211 of upright 106.

Side walls 214 of insert 202 include multiple internal protrusions 222 that are regularly spaced, and engage with rail 108 to secure rail 108 to insert 202. Though internal protrusions 222 illustrated in FIG. 2B have a rectangular shape, internal protrusions 222 may have any other alternative shape, such as polygonal, oval, and the like. An adhesive may be applied, resulting in an adhesive joint between insert 202 and upright 106.

Insert 202 further includes a support portion 224 extending from rear wall 212. Support portion 224 may have a hollow elongated structure having a suitable cross-section that may be received within a channel 226 of rail 108. Channel 226 may extend along a length of rail 108 (i.e., along the transverse axis 'T') and slidably receive balusters 112 therein. Support portion 224 may guide rail 108 during insertion into insert 202, and at least reduce any lateral movement of rail 108.

In some other embodiments, mechanical fasteners 228 couple insert 202 to rail 108. Mechanical fasteners 228 may be screws, bolts, and the like. Mechanical fasteners 228 may extend from top wall 216 of insert 202, through rail 108 and into support portion 224. In another embodiment, mechanical fasteners 228 also may extend through bottom wall 218 of insert 202. In the illustrated embodiment, mechanical fasteners 228 extend substantially parallel to longitudinal axis 'L'. Mechanical fasteners 228 may be installed after insertion of rail 108 into insert 202. Though two such mechanical fasteners 228 are illustrated in FIGS. 3 and 4, any number of mechanical fasteners 228 may be used.

As illustrated in FIG. 4, rear wall 212 of insert 202 may abut second wall 206 of upright 106 in the coupled state. In an embodiment, insert 202 may be fixedly coupled to upright 106 via an adhesive. Rear wall 212 may include recesses (not shown) that may facilitate application of adhesive and subsequent bonding with second wall 206 of upright 106. The adhesive may be, but is not restricted to, PVC glue or PVC cement. The adhesive may be applied on second wall 206, third wall 207 and/or fourth wall 208 (shown in FIG. 5A) of upright 106. The adhesive also may be additionally applied on rear wall 212 and/or side walls 214 of insert 202 (shown in FIG. 3). Moreover, upright 106 may include one or more support walls (not shown) to support insert 202 within a space 230 formed between first and second walls 204, 206. For example, one of support walls may support bottom wall 218 of upright 106 in the coupled state. Further, the support walls also may help in positioning insert 202 within upright 106 such that cavity 220 of insert 202 (shown in FIG. 7C) is aligned with lateral opening 210 (shown in FIG. 5B) of upright 106. This may facilitate insertion of rail 108 through lateral opening 210 into cavity 220. The adhesive may be applied further on the support walls. In an embodiment, mechanical fasteners 228 may extend further through the support walls to secure insert 202, upright 106 and rail 108 with each other.

In various embodiments, insert 202 may be coupled to rail 108 and/or upright 106 by adhesives, mechanical fasteners 228, friction fit, or any combination thereof. In other embodiments, insert 202 may be coupled to rail 108 and/or upright 106 by other attachment methods, for example, a tongue and groove joint, a snap-fit connection, welding, brazing and so on.

As illustrated in FIG. 4, cap 110 covers longitudinal opening 211 of upright 102. Cap 110 may be secured to upright 106 without any additional fasteners that may be visible from outside. Cap 110 also may prevent insert 202 and mechanical fasteners 228 to be visible from outside, thereby improving an aesthetic appearance of fence gate system 100. Cap 110 may be secured to upright 106 by various methods, such as, but not limited to, a tongue and groove joint, a snap-fit connection, a screwed joint, welding, adhesives, brazing, and so forth. Cap 110 also may be detachably coupled to upright 106 to enable any maintenance and/or repair activities.

Figure 6A:
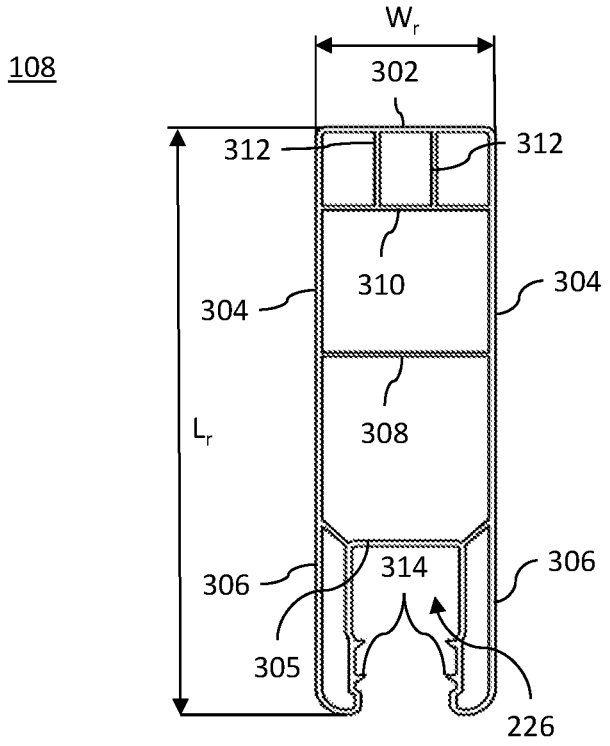
FIG. 6A is a front view of a rail member of the fence gate system, according to embodiments disclosed herein.
Figure 6B:
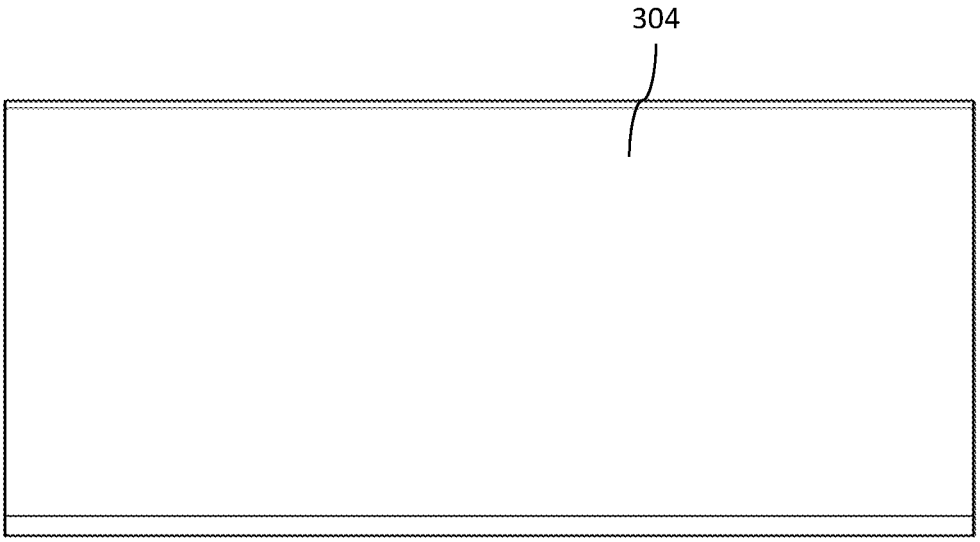
FIG. 6B is a side view of the rail member depicted in FIG. 6A.

FIGS. 6A and 6B illustrate front and side views, respectively, of rail 108. Rail 108 has a substantially hollow elongated structure including a top section 302, a pair of side sections 304 extending from top section 302, a bottom section 305 extending between the pair of side sections 304, and two legs 306 extending from bottom section 305. Mechanical fasteners 228 (shown in FIG. 4) may extend through top section 302 and bottom section 305 in order to couple rail 108 to insert 202. Further, upon insertion within cavity 220 (shown in FIG. 7C), bottom wall 218 (shown in FIG. 4) may support legs 306 of rail 108 thereon. Rail 108 further includes a first horizontal member 308 and a second horizontal member 310 extending between the pair of side sections 304. Rail 108 also includes pair of vertical members 312 extending between top section 302 and second horizontal member 310. First and second horizontal members 308, 310 and vertical members 312 may act as stiffeners and impart structural strength to rail 108.

As illustrated in FIG. 6A, bottom section 305 and legs 306 form channel 226 to receive one or more balusters 112 (shown in FIG. 2B) and support portion 224 of insert 202 therein. Therefore, channel 226 slides on support portion 224 upon insertion of rail 108 within cavity 220 (shown in FIG. 7C) of insert 202. Each of legs 306 include multiple projections 314 that extend into channel 226 and also extend laterally along the length of channel 226. Projections 314 may be flexible ridges that guide support portion 224 and secure rail 108 to insert 202. Projections 314 also may engage with balusters 112 and retain them within channel 226. Projections 314 may be integrally formed with corresponding legs 306. Alternatively, projections 314 may be separately manufactured and attached to corresponding legs 306 via various methods, such as, adhesives, mechanical fastening, welding, brazing, dovetailing, etc.

As illustrated in FIG. 6A, rail 108 may have a width 'Wr' and a length 'Lr'. Referring to FIGS. 5B and 6A, width 'Wr' and length 'Lr' may be less than or equal to width 'Wo' and the length 'Lo', respectively, of lateral opening 210 in order to facilitate insertion of rail 108 through lateral opening 210 into upright 106.

Figure 7A:
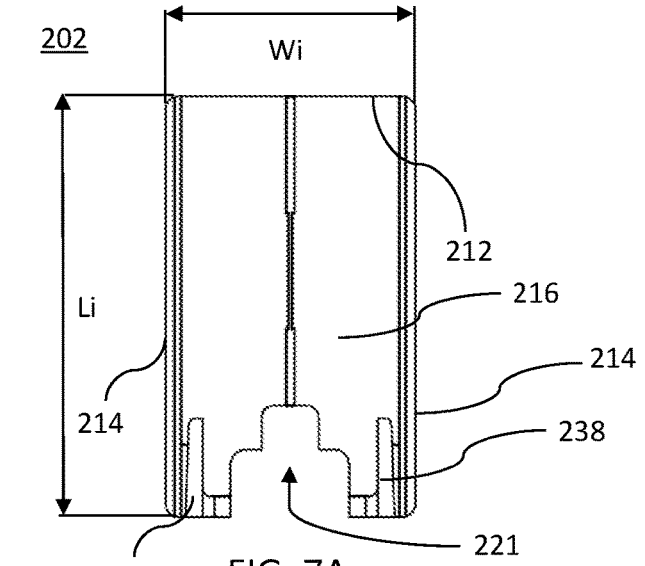
FIG. 7A to 7C illustrate various views of an insert of the fence gate system, according to embodiments disclosed herein.
Figure 7B:
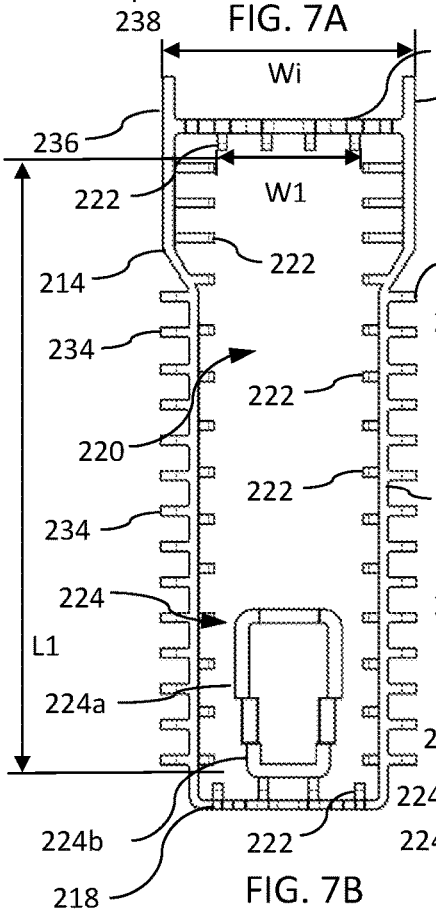
Figure 7C:
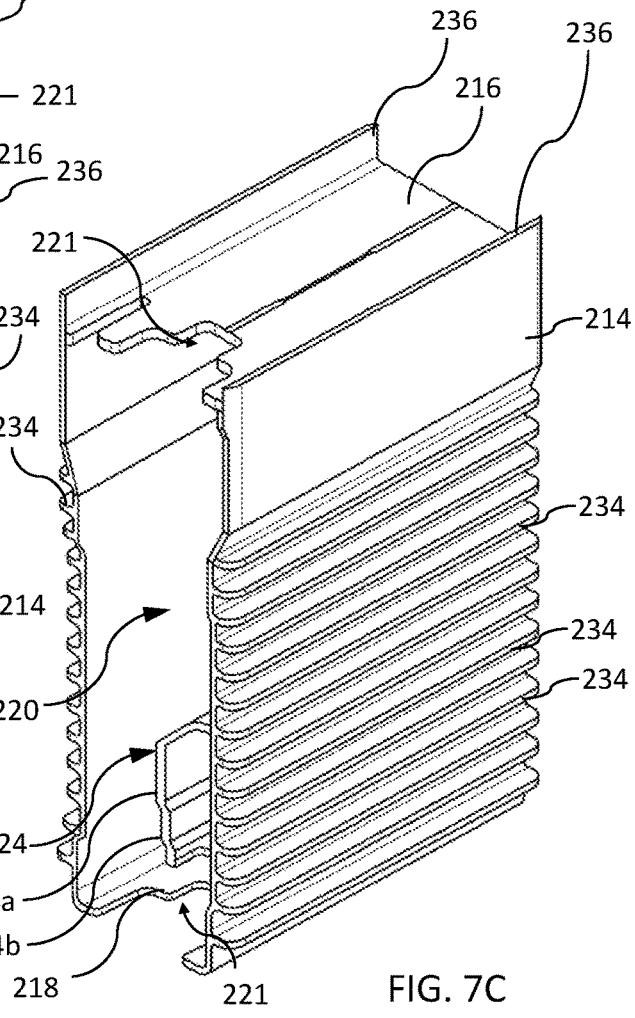

FIGS. 7A, 7B and 7C illustrate a top view, a front view and a perspective view, respectively, of insert 202. Insert 202 includes rear wall 212, pair of side walls 214 extending from rear wall 212, top wall 216 extending from rear wall 212 and disposed between side walls 214, and bottom wall 218 opposite to top wall 216. Rear wall 212, top wall 216, pair of side walls 214 and bottom wall 218 together at least partially enclose cavity 220 to at least partly receive therein rail 108 (shown in FIGS. 6A and 6B). Top wall 216 and bottom wall 218 includes groove 221 that is similar in shape to groove 209 (shown in FIG. 5A) in order to facilitate insertion of insert 202 through longitudinal openings 211 of upright 106. Top wall 216 and bottom wall 218 also may include a pair of cut outs 238 between groove 221 and side walls 214. The cut outs 238 may flex during insertion of rail 108 into insert 202 and help in accommodating rail 108 at least partly within cavity 220. Further, an upper part of each of side walls 214 may diverge and provide a width greater than a width formed between a lower part of each of side walls 214.

As illustrated in FIG. 7B, each of side walls 214, top wall 216 and bottom wall 218 include multiple internal protrusions 222 to engage with rail 108 to secure rail 108 to insert 202. Internal protrusions 222 extend from each of side walls 214 into cavity 220 of insert 202. Internal protrusions 222 also extend from top wall 216 and bottom wall 218 into cavity 220. The internal protrusion 222 extending from side walls 214 may have a variable length in order to maintain a uniform internal width 'Wi' between internal protrusions 222. Specifically, internal protrusions 222 extending from the lower part of each of side walls 214 may have a length that is lesser than a length of internal protrusions 222 extending from the upper part of each of side walls 214. Moreover, internal protrusions 222 extending from top and bottom walls 216, 218 also may provide an internal length 'Li' there between. In an embodiment, internal width 'Wi' and internal length 'Li' may be lesser than or equal to width 'Wr' and length 'Lr', respectively, of rail 108 in order to enable a friction fit between insert 202 and rail 108. In a further embodiment, internal protrusions 222 may deform during insertion of rail 108 into cavity 220 and grip rail 108 in order to retain more effectively rail 108 within cavity 220. Though internal protrusions 222, as illustrated in FIG. 7B, have a substantially rectangular shape, internal protrusions 222 may have any other alternative shape, such as polygonal, oval and the like.

In an embodiment, internal protrusions 222 may only extend partially along a length of insert 202. For example, internal protrusions 222 may be located adjacent to rear wall 212. Further, internal protrusions 222 also may be connected to rear wall 212. However, in alternative embodiments, internal protrusions 222 may extend along the length of insert 202.

In an embodiment, internal protrusions 222 may be integral with the corresponding walls of insert 202. An adhesive may be applied, resulting in an adhesive joint between insert 202 and rail 108.

As illustrated in FIGS. 7B and 7C, each of side walls 214 include a plurality of external protrusions 234 configure to engage with upright 106 (shown in FIG. 5A) to secure insert 202 to upright 106 (not shown). Specifically, external protrusions 234 may engage with third and fourth walls 207, 208 of upright 106. In an embodiment, external protrusions 234 also may deform during insertion of insert 202 to retain insert 202 within upright 106.

In the illustrated embodiment, external protrusions 234 extend along the length of insert 202. However, in an alternative embodiment, external protrusions 234 may extend only partly along the length of insert 202. Further, external protrusions 234 are present only on the lower parts of side walls 214 and absent on the upper parts. This may enable width 'Wi' of insert 202 to be uniform. Further, in an embedment, width 'Wi' of insert 202 may be greater than or equal to width 'Wu' of upright 106 in order to enable a friction fit between insert 202 and upright 106 (shown in FIG. 3). External protrusions 234 also may facilitate application of an adhesive on side walls 214 to form an adhesive joint between insert 202 and upright 106. External protrusions 234 may further impart structural strength to insert 202.

Though external protrusions 234 illustrated in FIG. 7B have a rectangular shape, external protrusions 234 may have any other alternative shape, such as polygonal, oval, and the like. Further, external protrusions 234 may be deformable to enable insert 202 to be inserted within longitudinal opening 211 of upright 106. In an embodiment, external protrusions 234 may be integral with side walls 214 and have a coating to increase friction between insert 202 and upright 106. In an alternative embodiment, external protrusions 234 may be made of a material different from a material of side walls 214, and may be attached to side walls 214 by various methods, such as adhesives, welding, brazing, and the like.

Referring to FIGS. 7B and 7C, top wall 216 includes a pair of extensions 236 that are flush with end surface 213 (shown in FIG. 5B) of upright 106 in the coupled state of insert 202. Extensions 236 may act as an indicator of a proper placement of insert 202 within longitudinal opening 211 of upright 106. Specifically, when extensions 236 are flush with end surface 213, insert 202 is longitudinal aligned with lateral opening 210. In the illustrated embedment, extensions 236 extend from two ends of top wall 216 and are substantially perpendicular to top wall 216. However, extensions 236 may be disposed at any intermediate location on top wall 216. Further, extensions 236 also may be oriented at any suitable angle with respect to top wall 216. Though extensions 236 are illustrated as being substantially rectangular, extensions 236 may have substantially any suitable alternative shape, such as polygonal, oval etc.

Insert 202 further includes support portion 224 extending from rear wall 212. Support portion 224 includes a first section 224*a* and a second section 224*b*. A width of first section 224*a* may be greater than a width of second section 224*b*. First section 224*a* may receive legs 306 (shown in FIG. 6A) and bottom section 305 of rail 108 thereon during insertion of rail 108 into cavity 220. Second section 224*b*, having the lesser width, may enable insertion of projections 314 of legs 306. Projections 314 may engage with second section 224*b* to guide and to retain rail 108 within cavity 220. Therefore, a shape and dimensions of support portion 224 may be based on a shape and dimensions of channel 226 of rail 108.

Figure 8A:
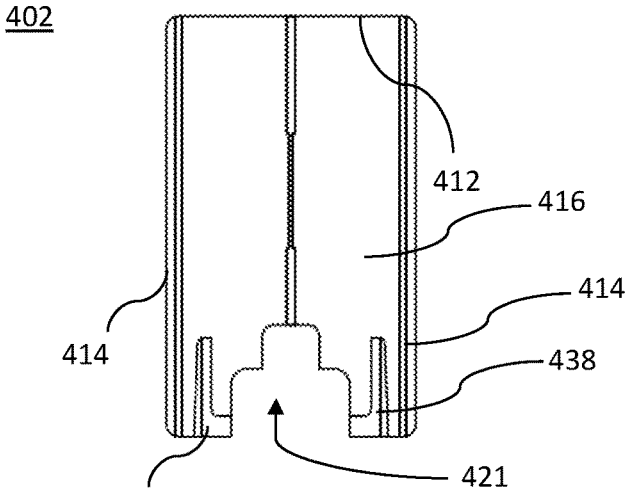
FIG. 8A to 8C illustrate various views of an insert of the fence gate system, according to embodiments disclosed herein.
Figure 8B:
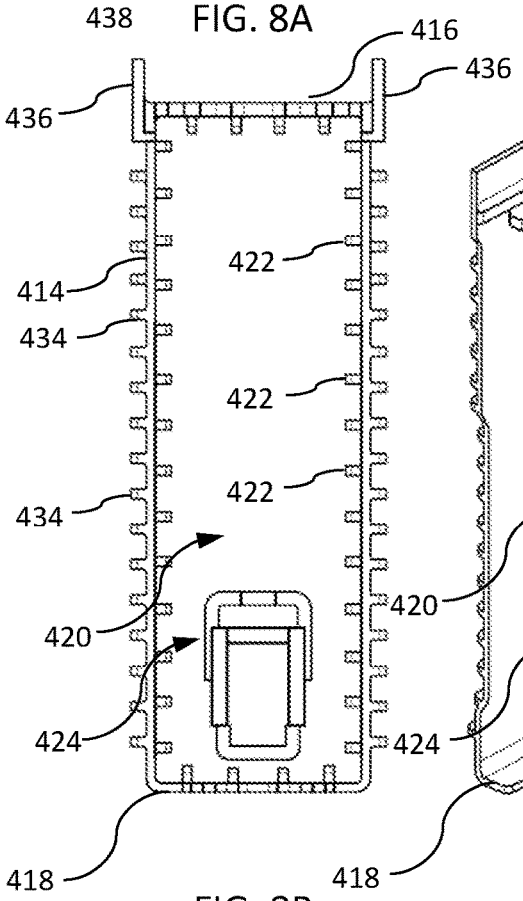
Figure 8C:
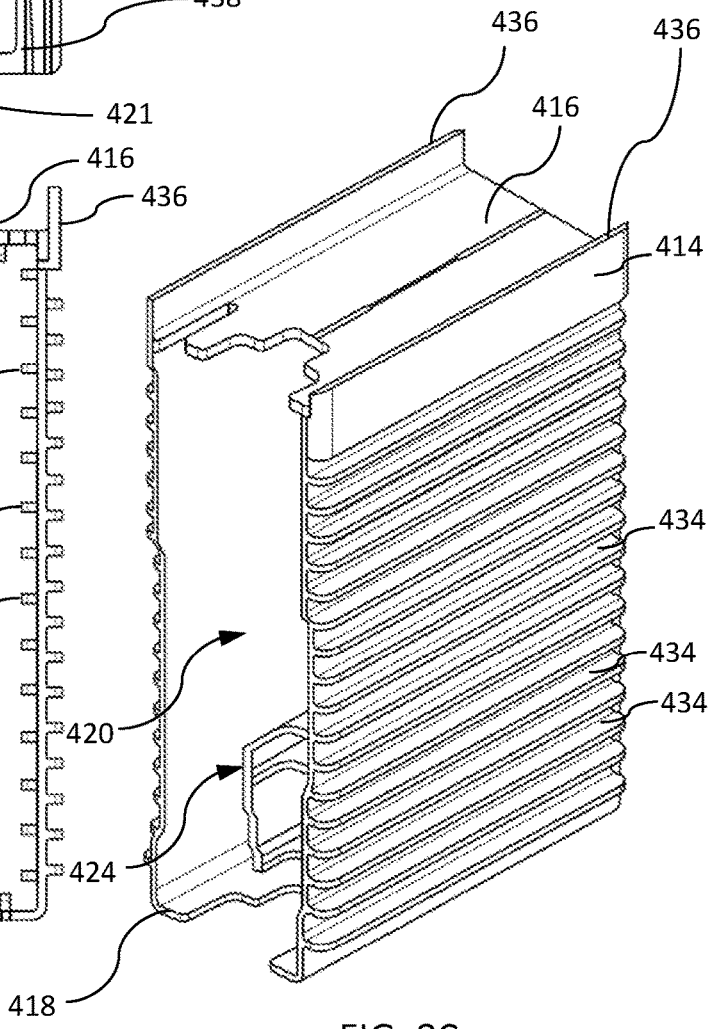

FIGS. 8A, 8B and 8C illustrate a top view, a front view and a perspective view, respectively, of an insert 402, according to an embodiment of the present disclosure. Side walls 414 of insert 402 provide a uniform width between them. Accordingly, internal protrusions 422 extending from side walls 414 have similar lengths. Moreover, external protrusions 434 are located throughout a length of each of side walls 414. The extensions 436 also protrude beyond a length of top wall 418 to maintain a uniform external width. Other features of insert 402 may be substantially identical or equivalent to insert 202.

Figure 9A:
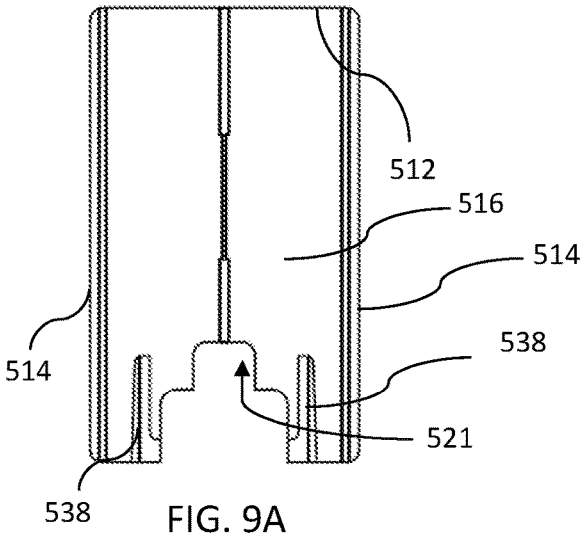
FIG. 9A to 9C illustrate various views of an insert of the fence gate system, according to embodiments disclosed herein.
Figure 9B:
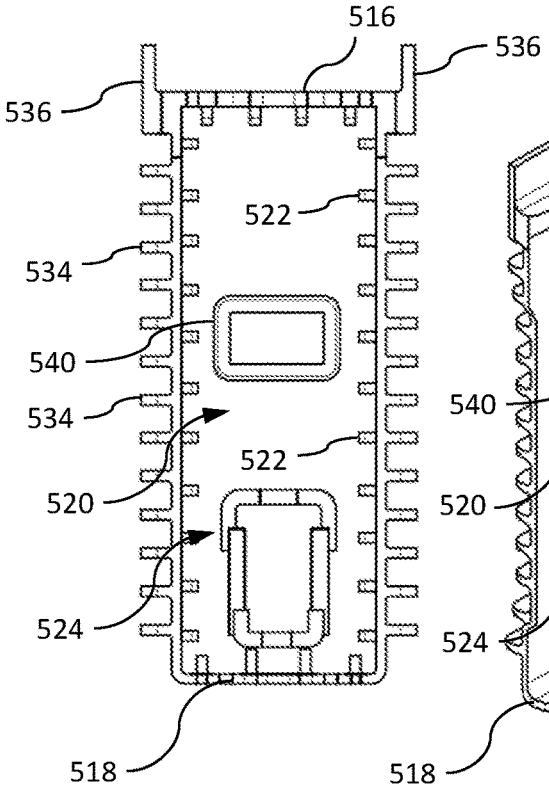
Figure 9C:
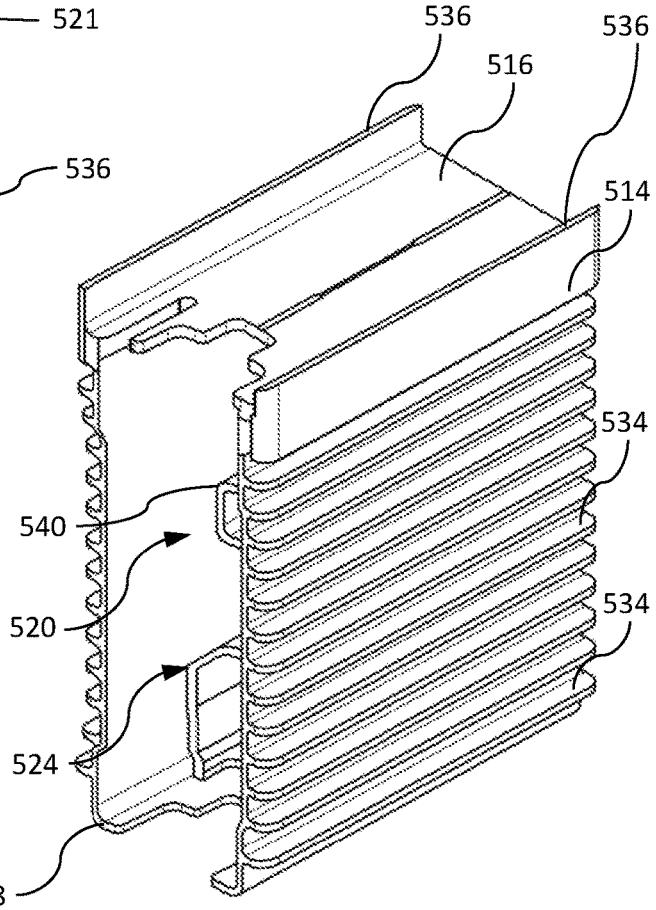

FIGS. 9A, 9B and 9C illustrate a top view, a front view and a perspective view, respectively, of an insert 502, according to an embodiment of the present disclosure. Side walls 514 of insert 502 provide a uniform width between them. Accordingly, internal protrusions 522 extending from side walls 514 have similar lengths. Moreover, external protrusions 534 are located throughout a length of each of side walls 514. The extensions 536 also protrude beyond a length of top wall 518 to maintain a uniform external width. Insert 502 further includes an auxiliary support portion 540 extending from a rear wall 512. Auxiliary support portion 540 may support first horizontal member 308 (shown in FIG. 6A) of rail 108. Further, auxiliary support portion 540 is substantially rectangular with chamfered edges. However, auxiliary support portion 540 may have any alternative shape, such as elliptical, polygonal, circular, and so forth. Other features of insert 502 may be substantially identical or equivalent to insert 202.

Figure 10A:
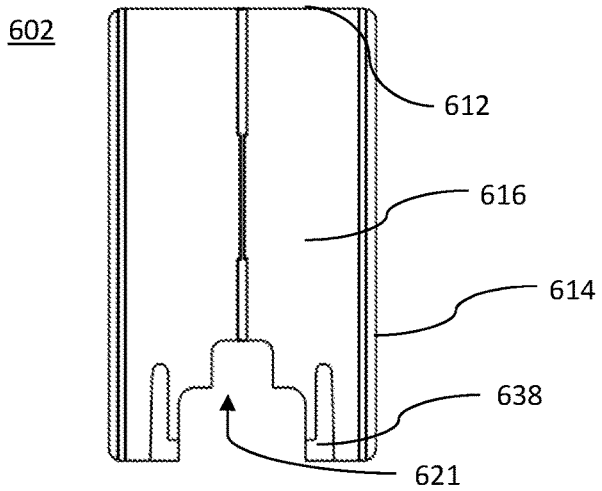
FIG. 10A to 10C illustrate various views of an insert of the fence gate system, according to embodiments disclosed herein.
Figure 10B:
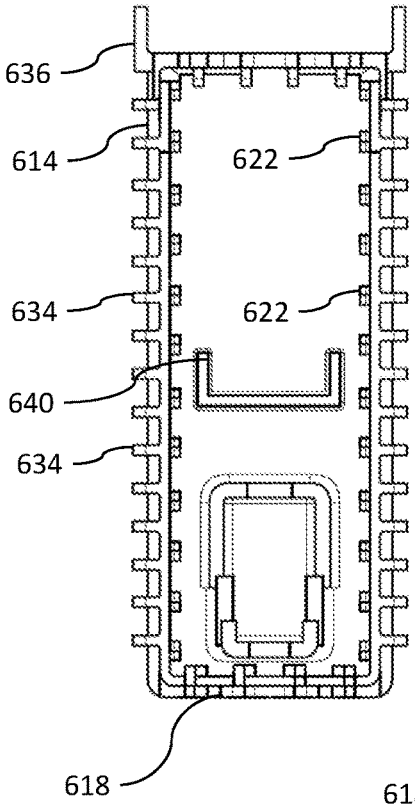
Figure 10C:
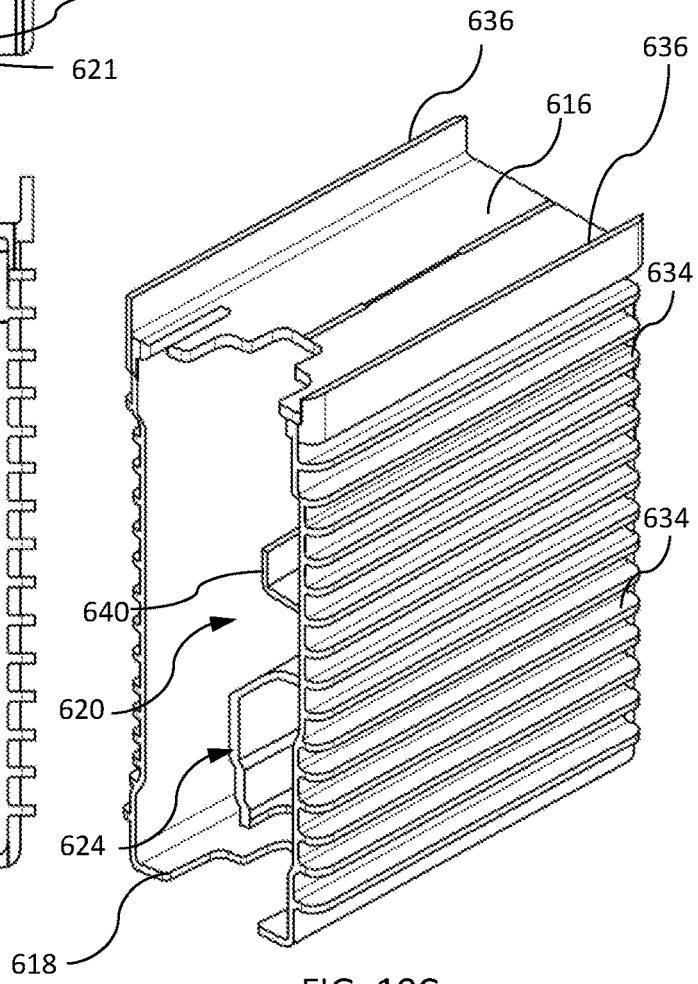

FIGS. 10A, 10B and 10C illustrate a top view, a front view and a perspective view, respectively, of an insert 602, according to an embodiment of the present disclosure. Side walls 614 of insert 602 provides a uniform width between them. Accordingly, internal protrusions 622 extending from side walls 614 have similar lengths. Moreover, external protrusions 634 are located throughout a length of each of side walls 614. The extensions 636 also protrude beyond a length of top wall 618 to maintain a uniform external width. Insert 602 further includes an auxiliary support portion 640 extending from a rear wall 612. Auxiliary support portion 640 may support first horizontal member 308 (shown in FIG. 6A) of rail 108. Further, auxiliary support portion 640 is substantially U-shaped. Other features of insert 602 may be substantially identical or equivalent to insert 202.

Each of inserts 202, 402, 502 and 602 may correspond to a particular rail configuration and/or upright configuration. Further, each of inserts 202, 402, 502 and 602 may have one or more markings to match the corresponding insert with the corresponding rail and/or upright. The markings may include alphabets, numbers, alphanumeric codes, symbols, and so forth.

An exemplary assembling operation of fence gate assembly 118 will be explained hereinafter with reference to FIGS. 1 to 7C. Different components of fence gate assembly 118 may be available as a fence gate kit that may include uprights 106 with corresponding inserts 202 pre-installed therein, rails 108, balusters 112, mechanical fasteners 228, cap 110 and hinges 104. The fence gate kit may additionally include an adhesive dispenser, multiple U-channels and post 102. However, post 102 may be pre-installed in ground surface 'S' and may not be part of the fence gate kit.

Balusters 112 and the U-channels may be laid on a suitable surface with balusters 112 arranged next to each other and between the U-channels. Balusters 112 at each end may be coupled to the corresponding U-channels. Balusters 112 and the U-channels may be then slid into channels 226 of each of rails 108. Rails 108 may be then coupled to inserts 202 that are pre-installed within uprights 106 at both ends. The U-channels also may be slid within grooves 209 formed by first walls 204 of corresponding uprights 106. In an embodiment, the adhesive dispenser may be used to apply an adhesive on internal surfaces of inserts 202 and/or external surfaces of rails 108. Rails 108 may be then slid through corresponding lateral openings 210 into cavities 220 of corresponding inserts 202. Rails 108 may be slid along transverse axis 'T' for coupling with corresponding inserts 202. Mechanical fasteners 228 may be then installed through longitudinal openings 211 of corresponding uprights 106 in order to secure rails 108 to inserts 202. Specifically, mechanical fasteners 228 may be struck with a tool (for example, a hammer) to drive mechanical fasteners 228 through top wall 216 of corresponding inserts 202 into corresponding rails 108. Caps 110 may be then used to close longitudinal openings 211 from top ends 114 of corresponding uprights 106. Optionally, caps 110 also may be provided at bottom ends 116 of corresponding uprights 106. Rails 108, balusters 112, the U-channels, uprights 106 and caps 110 may thus form fence gate assembly 118.

The first parts 104*a* of hinges 104 may be coupled to post 102. Fence gate assembly 118 may be placed at a suitable height and distance with respect to post 102, and second parts 104*b* of hinges 104 are coupled to upright 106 adjacent to post 102. Thus, fence gate system 100 is formed.

The above assembly operation is purely exemplary in nature, and fence gate assembly 118 and fence gate system 100 may be assembled in any alternative manner as per the convenience of an end user.

Inserts 202 are pre-installed within uprights 106 in order to enable the end user to directly insert rail 108 into cavity 220 formed by insert 202. In particular, the end user mainly may slide the elements without use of specialized skill or tools. Thus, a time and complexity associated with assembling fence gate system 100 may be reduced.

Apart from the installation of mechanical fasteners 228, the end user may not have to handle any tools or perform any striking/drilling operations. This may enhance the safety of the assembling operation. In an embodiment, rail 108 may be retained within insert 202 by friction fit and/or adhesives, and may not require additional fasteners. Therefore, the fence gate kit may be assembled without any tools or fasteners that may be dangerous to the end user.

Further, inserts 202 are enclosed completely within uprights 106, and caps 110 close longitudinal openings 211. Therefore, fence gate assembly 118 does not have any external brackets or fasteners, thereby improving an aesthetic appeal of fence gate assembly 118. Lack of external brackets, fasteners or protruding structures may enable the end user easily to paint various components of fence gate assembly 118, if required.

Caps 110 also may prevent entry of moisture or particulate matter within longitudinal openings 211. This may prevent damage and corrosion to the internal components, and thus increase a life of fence gate assembly 118.

Different inserts may be provided within uprights 106 in order to allow end users to install a rail and picket assembly of their choice.

Figure 11:
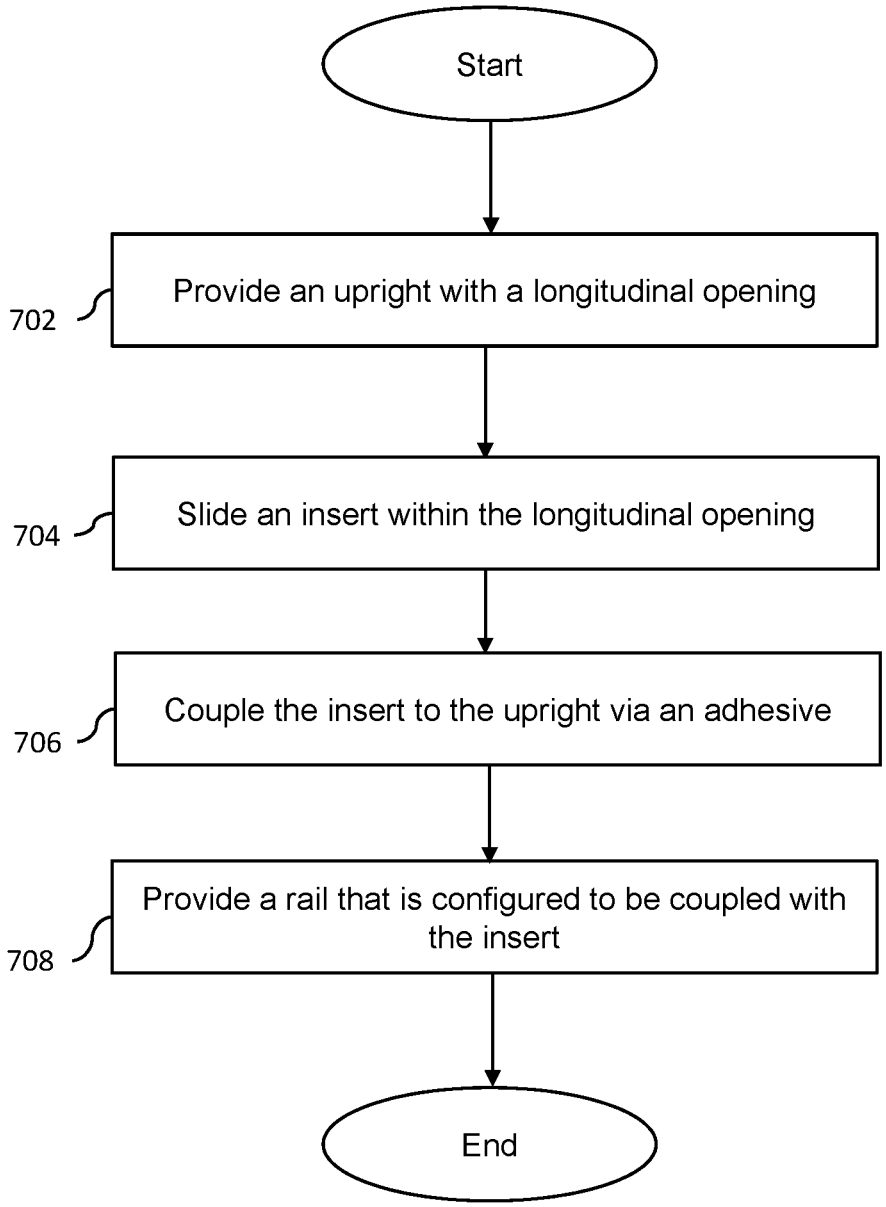
FIG. 11 illustrates a method of manufacturing a fence gate kit, according to embodiments disclosed herein.

FIG. 11 is a flowchart of an exemplary method 700 of manufacturing the fence gate kit in accordance with an embodiment of the disclosed subject matter. The flowchart is provided merely for exemplary purposes, and embodiments are intended to include or otherwise cover any methods or procedures for manufacturing the fence gate kit.

At step 702, method 700 includes providing upright 106 including first wall 204 having two lateral openings 210, second wall 206 opposite to first wall 204, a third wall 207 extending from between first and second walls 204, 206, and fourth wall 208 spaced from third wall 207 and extending between first and second walls 204, 206. The first, second, third and fourth walls 204, 206, 207 and 208 form a longitudinal opening 211. Upright 106 may be formed by various manufacturing methods, such as molding, casting, machining or a combination thereof. The walls of upright 106 may be formed integrally (e.g., extruded) or may be manufactured separately and then assembled together. In the illustrated embodiment, two uprights 106 may be provided.

Method 700 may further include providing balusters 112, caps 110, hinges 104 and mechanical fasteners 228. Balusters 112 are received slidably in channel 226 of rail 108. Cap 110 closes longitudinal opening 211 of corresponding upright 106.

At step 704, method 700 includes sliding insert 202 within longitudinal opening 211 of upright 106. Insert 202 may be inserted into upright 106 along longitudinal axis 'L'. Insert 202 includes rear wall 212, side walls 214 and support portion 224 extending from rear wall 212. Further, rear wall 212 and side walls 214 at least partly enclose cavity 220.

Insert 202 may be formed by various manufacturing methods, such as molding, casting, machining or a combination thereof. The walls and support portion 224 of insert 202 may be integrally formed or may be manufactured separately and then assembled together.

In the illustrated embedment, two inserts 202 may be inserted within each of uprights 106, one from top end 114 and another from bottom end 116. Prior to insertion of insert 202, an adhesive, such as PVC cement, may be applied on external surfaces of rear wall 212 and side walls 214. Additionally, the adhesive may be applied on interior surfaces of uprights 106.

At step 706, method 700 includes coupling insert 202 to upright 106 via the adhesive. An additional curing process may be required to form the adhesive joint between insert 202 and upright 106. Insert 202 may be additionally or optionally coupled to the upright via fasteners, mechanical joints, friction fit, or a combination thereof.

At step 708, method 700 includes providing rails 108 inserted through lateral opening 210 and at least partly received within cavity 220 of insert 202. Rail 108 further includes channel 226 slidably received on support portion 224 of insert 202. Mechanical fasteners 228 may be installed to couple rail 108 to insert 202 after sliding rail 108 within cavity 220.

Rail 108 may be formed by various manufacturing methods, such as molding, casting, machining or a combination thereof. Various sections of rail 108 may be integrally formed or may be manufactured separately and then assembled together.

Though the above embodiments are described with reference to a fence gate system and assembly, embodiments of the present disclosure are intended to cover any fence assembly having one or more uprights with inserts pre-installed within the uprights. The pre-installed inserts may be easily coupled with corresponding rails, thereby enabling quick and simple assembly of the fence.

Although the invention has been described with reference to exemplary embodiments, it is not limited thereto. Changes and modifications may be made to the preferred embodiments of the invention and that such changes and modifications may be made without departing from the spirit of the invention. The claims are intended to cover all such equivalent variations as fall within the spirit and scope of the invention.

To avoid unnecessarily obscuring the present invention, the preceding description omits well known structures and devices. This omission is not to be construed as a limitation of the scope of the present invention. Specific details are set forth by use of the embodiments to provide an understanding of the present invention. However, the present invention may be practiced in a variety of ways beyond the specific embodiments set forth herein.

A number of embodiments of the present invention may be practiced. It is possible to provide for some features of the present invention without providing others.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease and/or reducing cost of implementation.

The foregoing discussion of the present invention has been presented for purposes of illustration and description. It is not intended to limit the present invention to the form or forms disclosed herein. In the foregoing detailed description, for example, various features of the present invention are grouped together in one or more embodiments, configurations, or aspects for the purpose of streamlining the disclosure. The features of the embodiments, configurations, or aspects may be combined in alternate embodiments, configurations, or aspects other than those discussed above. This method of disclosure is not to be interpreted as reflecting an intention the present invention requires more features than are recited expressly in each claim. Rather, as the following claims reflect, inventive aspects lie in less than all features of a single foregoing disclosed embodiment, configuration, or aspect. Thus, the following claims are hereby incorporated into this detailed description, with each claim standing on its own as a separate embodiment of the present invention.

Moreover, though the description of the present invention has included description of one or more embodiments, configurations, or aspects and certain variations and modifications, other variations, combinations, and modifications are within the scope of the present invention, e.g., as may be within the skill and knowledge of those in the art, after understanding the present disclosure, without intending to publicly dedicate any patentable subject matter.

What is claimed is:

1. A fence gate assembly comprising:

an upright comprising a first wall, a second wall opposite to the first wall, a third wall extending between the first and second wall, and a fourth wall spaced from the third wall and extending between the first wall and the second wall, wherein the first wall, the second wall, the third wall and the fourth wall provide a longitudinal opening;

an insert received by the longitudinal opening of the upright and coupled to the upright via an adhesive, the insert comprising:

a rear wall abutting the second wall of the upright in the coupled state of the insert;

a pair of side walls extending from the rear wall, wherein the rear wall and the pair of side walls at least partly enclose a cavity; and a support portion extending from the rear wall and disposed between the pair of side walls; and a rail at least partially within the cavity of the insert, the rail comprising a channel to receive the support portion therein.

2. The fence gate assembly of claim 1, wherein the first wall of the upright comprises a lateral opening to receive the rail.

3. The fence gate assembly of claim 1, further comprising a cap to cover a longitudinal opening of the upright.

4. The fence gate assembly of claim 1, further comprising a plurality of mechanical fasteners to couple the insert to the rail.

5. The fence gate assembly of claim 4, wherein the insert further comprises a top wall extending from the rear wall, and wherein each of the plurality of mechanical fasteners extends through the top wall of the insert and at least one section of the rail.

6. The fence gate assembly of claim 5, wherein the top wall comprises a pair of extensions, and wherein the pair of extensions are flush with an end surface of the upright in the coupled state of the insert.

7. The fence gate assembly of claim 5, wherein the insert further comprises a bottom wall opposite to the top wall and extending from the rear wall, and wherein the bottom wall supports the rail.

8. The fence gate assembly of claim 7, wherein at least one of the top wall and the bottom wall comprises a plurality of internal protrusions to engage with the rail in order to secure the rail to the insert.

9. The fence gate assembly of claim 1, wherein each of the pair of side walls of the insert comprises a plurality of exterior protrusions to engage with the third wall and the fourth wall of the upright in order to secure the insert to the upright.

10. The fence gate assembly of claim 1, wherein each of the pair of side walls comprises a plurality of interior protrusions to engage with the rail in order to secure the rail to the insert.

11. The fence gate assembly of claim 1, further comprising:

a post; and a hinge pivotally coupling the upright to the post.

12. The fence gate assembly of claim 1, further comprising a plurality of balusters coupled to the rail, wherein each of the plurality of balusters is at least partly received within the channel of the rail.

13. The fence gate assembly of claim 1, wherein the rail includes a plurality of barbs extending into the channel, and wherein each of the plurality of barbs at least partially secures the rail to the support portion of the insert.

14. The fence gate assembly of claim 1, further comprising a cap to close the longitudinal opening of the upright.

15. A method of manufacturing a fence gate kit, the method comprising:

providing an upright comprising a first wall, a second wall opposite to the first wall forming a lateral opening, a third wall extending between the first and second wall, and a fourth wall spaced from the third wall and extending between the first wall and the second wall, wherein the first wall, the second wall, the third wall and the fourth wall form a longitudinal opening;

sliding an insert within the longitudinal opening of the upright, the insert comprising a rear wall, a pair of side walls extending from the rear wall, and a support portion extending from the rear wall and disposed between the pair of side walls, wherein the rear wall and the pair of side walls at least partly enclosing a cavity;

adhering the insert to the upright; and inserting a rail through the lateral opening and at least partially into the insert, the rail comprising a channel slidably received on the support portion of the insert.

16. The method of claim 15, further comprising providing a plurality of balusters slidably received in the channel of the rail.

17. The method of claim 15, wherein the adhesive comprises PVC cement.

18. The method of claim 15, further comprising the step of closing the longitudinal opening of the upright by use of a cap.

19. The method of claim 15, further comprising the step of coupling the rail to the insert by use of a plurality of mechanical fasteners.

20. A fence gate system comprising:

a post extending from a ground surface;

a hinge coupled to the post;

an upright coupled to the hinge, the upright comprising a first wall comprising a lateral opening, a second wall opposite to the first wall, a third wall extending between the first and second wall, and a fourth wall spaced from the third wall and extending between the first wall and the second wall, wherein the first wall, the second wall, the third wall and the fourth wall forming a longitudinal opening;

an insert received within the longitudinal opening of the upright and coupled to the upright via an adhesive, the insert comprising:

a rear wall abutting the second wall of the upright in the coupled state of the insert;

a pair of side walls extending from the rear wall, wherein the pair of side walls and the rear wall at least partly enclose a cavity; and a support portion extending from the rear wall and disposed between the pair of side walls;

a rail inserted through the lateral opening and at least partially received by the insert, the rail further comprising a channel to receive at least partially the support portion;

a plurality of balusters slidably received with the channel of the rail; and a cap to close the longitudinal opening of the upright.

* * * * *